US008136381B2

(12) United States Patent
Murayama

(10) Patent No.: US 8,136,381 B2
(45) Date of Patent: Mar. 20, 2012

(54) HOG RING FASTENING DEVICE

(75) Inventor: Takashi Murayama, Hachioji (JP)

(73) Assignee: Meihotech Inc., Hachioji-shi, Tokyo (JP)

( * ) Notice: Subject to any disclaimer, the term of this patent is extended or adjusted under 35 U.S.C. 154(b) by 601 days.

(21) Appl. No.: 12/343,313

(22) Filed: Dec. 23, 2008

(65) Prior Publication Data

US 2009/0158809 A1 Jun. 25, 2009

(30) Foreign Application Priority Data

Dec. 25, 2007 (JP) ..... 2007-331549

(51) Int. Cl.
*B25C 5/13* (2006.01)

(52) U.S. Cl. ..... 72/453.01; 72/453.16; 72/409.03; 72/424; 29/243.56; 29/816

(58) Field of Classification Search ..... 72/409.03, 72/421, 453.01, 453.16; 29/243.56, 816, 29/818; 226/143, 151, 162, 167; 227/120, 227/130, 132, 138; 53/138.4
See application file for complete search history.

(56) References Cited

U.S. PATENT DOCUMENTS 3,628,230 A * 12/1971 Grise ..... 29/816
5,123,273 A * 6/1992 Kawabata ..... 72/409.03
5,483,815 A * 1/1996 West ..... 72/452.8
5,709,124 A * 1/1998 Murayama ..... 72/409.03
5,979,213 A * 11/1999 Toyoda ..... 72/409.02
6,035,690 A * 3/2000 Murayama ..... 72/409.02
7,395,688 B2 * 7/2008 Murayama ..... 72/409.03
2006/0112891 A1 6/2006 Murayama

FOREIGN PATENT DOCUMENTS

JP 2006-150510 A 6/2006

* cited by examiner

*Primary Examiner* — David Jones
(74) *Attorney, Agent, or Firm* — Birch, Stewart, Kolasch & Birch, LLP

(57) ABSTRACT

A hog ring fastening device is disclosed. The hog ring fastening device includes a body, a magazine attached to the body, jaws pivotally supported on the body, a main pneumatic cylinder for turning the jaws, a teed pneumatic cylinder fixed to the body and adapted to be retracted when the jaws are turned away from each other, a moving plate attached to a piston rod of the feed pneumatic cylinder, a push spring for pushing the moving plate in a feed direction with respect to a body of the feed pneumatic cylinder, a feed member provided at the moving plate, and a stopper attached to the body of the hog ring fastening device for preventing a hog ring assembly loaded on the magazine from moving in a direction opposite to the feed direction.

9 Claims, 9 Drawing Sheets

HOG RING FASTENING DEVICE

BACKGROUND OF THE INVENTION

1. Field of the Invention

The present invention relates to a hog ring fastening device including a C ring fastening device.

2. Description of the Related Art

As disclosed in Japanese Patent Application Laid-Open publication No. 2006-150510, a related art device for fastening a hog ring includes a device body, a first swing member turnably supported to the body, a push member provided at the first swing member, a feed pneumatic cylinder fixed to the first swing member, a second swing member turnably supported to the body, the feed pneumatic cylinder being contacted at a tip end of a piston rod thereof with the second swing member, a feed member provided at the second swing member, a push spring seat fixed to the body, a push spring provided between the push spring seat and the first swing member, and an extension spring provided between the first and second swing members.

In the hog ring fastening device, in a condition where the feed member finishes feeding of a hog ring assembly, the push member pushes the hog ring assembly in a feed direction, so that a foremost hog ring of the hog ring assembly can be surely fed to a fastening portion.

However, in such a hog ring fastening device, it is necessary to provide a push mechanism including the first swing member and the push member, whereby the structure of the hog ring fastening device becomes complicated and the production cost of the hog ring fastening device is increased.

SUMMARY OF THE INVENTION

It is an object of the present invention to provide a hog ring fastening device, the structure of which is simple and the production cost of which is low.

In accordance with an aspect of the present invention, there is provided a hog ring fastening device comprising a body, a magazine attached to the body, jaws pivotally supported on the body, a main pneumatic cylinder for moving the jaws toward or away from each other, a feed pneumatic cylinder fixed to the body and adapted to be contracted when the jaws are turned away from each other, a moving plate attached to a piston rod of the feed pneumatic cylinder, a push spring for pushing the moving plate in a feed direction with respect to a body of the feed pneumatic cylinder, a feed member located on the moving plate, and a stopper attached to the body of the hog ring fastening device for preventing a hog ring assembly loaded on the magazine from moving in a direction opposite to the feed direction.

In the above configuration, the provision of any pusher device is not required, so that the structure of the hog ring fastening device is simple and the production cost of the hog ring fastening device is low.

In the above configuration, the feed member may include two feed members.

In this configuration, the hog ring assembly can be interposedly held by the two feed members, so that the hog ring assembly can be securely fed in the feed direction.

In the above configuration, a feed member supporting portion may be located on the moving plate and the feed member may be rotatably supported to the feed member supporting portion.

In the above configuration, a support shaft may be attached to the feed member supporting portion and the feed member may be rotatably attached to the support shaft.

In the above configuration, a spiral spring may be provided around the support shaft, an end of the spiral spring maybe attached to the feed member supporting portion, and the other end of the spiral spring may be attached to the feed member.

In the above configuration, the feed member may be formed with a plurality of grooves.

In this configuration, side portions of hog rings are engaged in the grooves, so that the hog ring assembly can be securely fed in the feed direction.

In the above configuration, a holding plate may be fixed to the body of the hog ring fastening device, the feed pneumatic cylinder maybe fixed to the holding plate, and the push spring maybe provided between the holding plate and the moving plate.

In the above configuration, a stopper that includes first engaging portions and a second engaging portion adapted to be engaged, on a side opposite to the feed direction with respect to the first engaging portions, with the hog ring assembly loaded on the magazine may be employed as the stopper.

In this configuration, in a state where a rear end portion of the hog ring assembly is not engaged with the second engaging portion, when another hog ring assembly is loaded on the magazine, the above-mentioned another hog ring assembly is engaged at a foremost portion thereof with the second engaging portion, so that the loading operation of the above-mentioned another hog ring assembly on the magazine can be easily carried out.

In the above configuration, the stopper may be provided with a releasing portion.

DETAILED DESCRIPTION OF THE INVENTION

Figure 1:
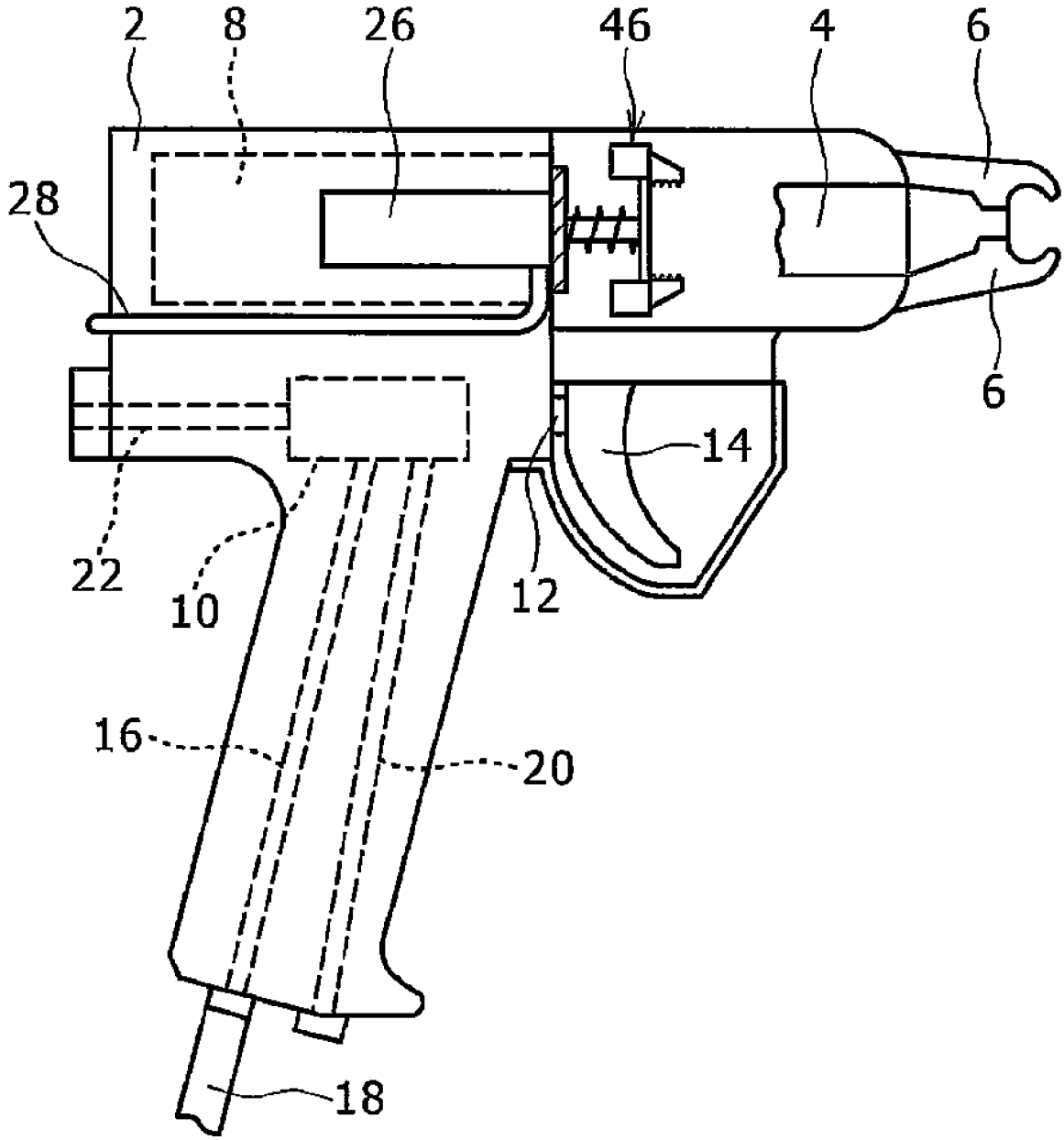
FIG. 1 is a partially abbreviated schematic-view illustrating a C ring fastening device according to an embodiment of the present invention.
Figure 2:
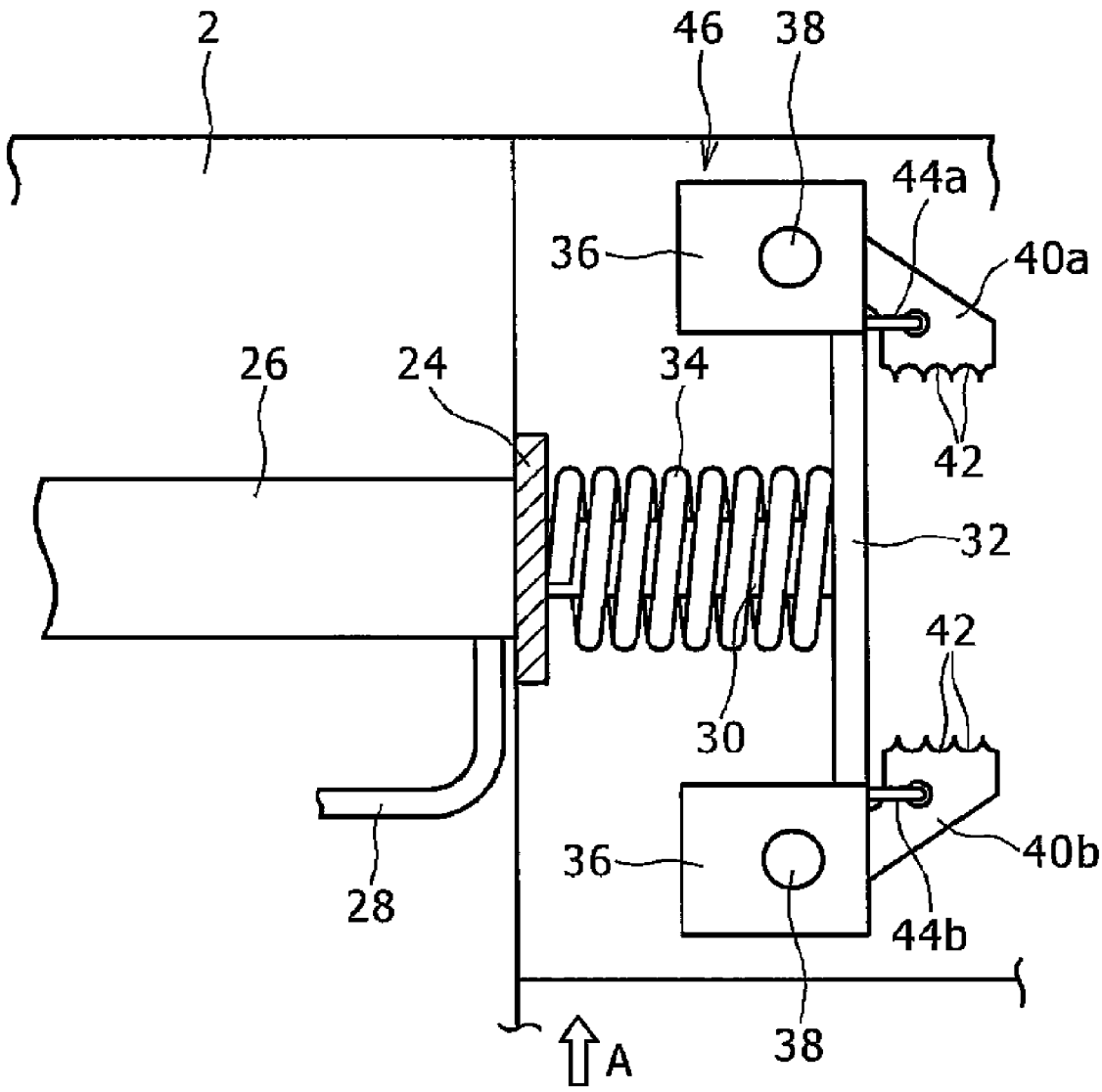
FIG. 2 is a partially abbreviated enlarged-view illustrating a part of the C ring fastening device shown in FIG. 1.
Figure 3:
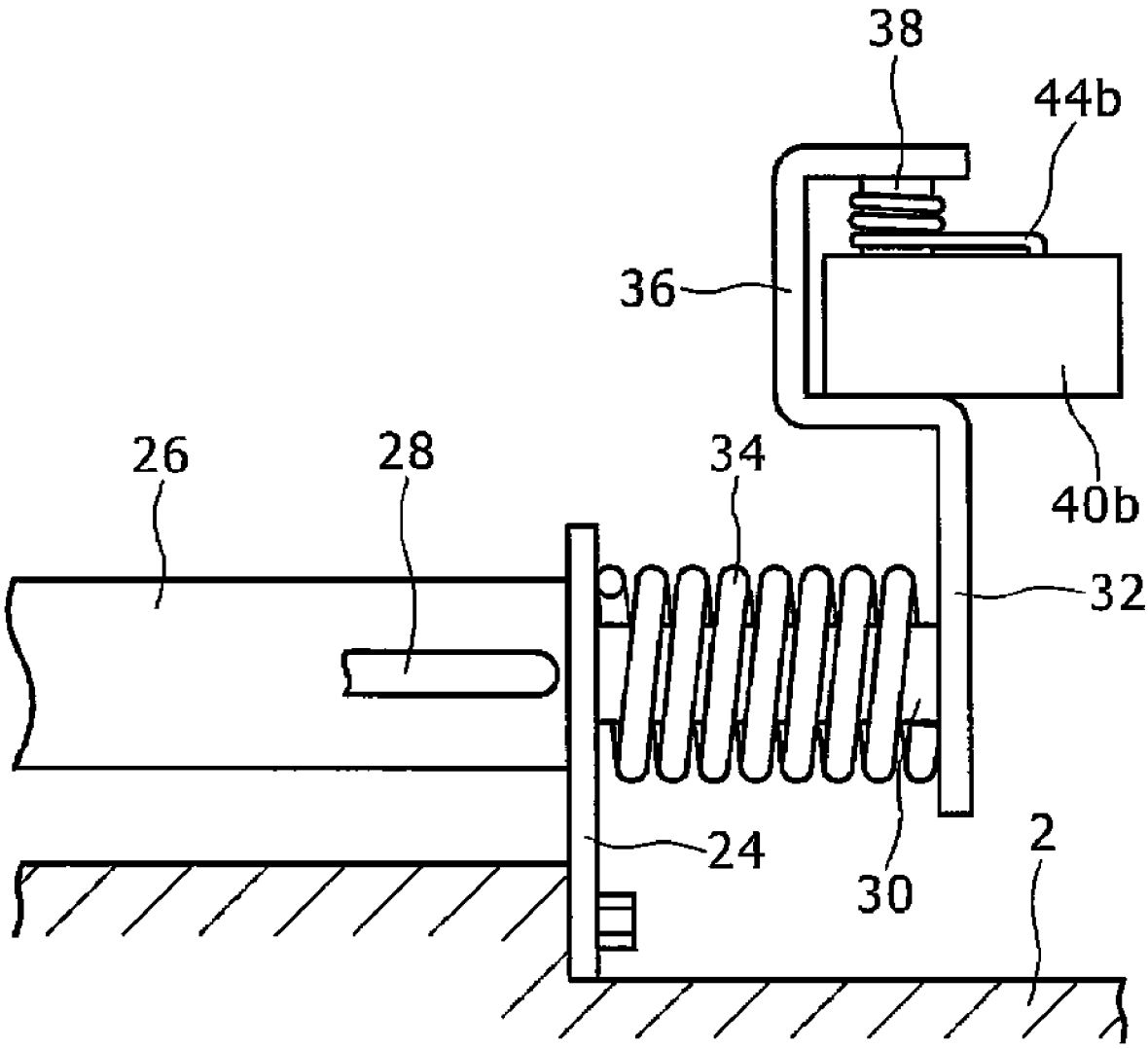
FIG. 3 is a partially abbreviated view of the C ring fastening device, as viewed from an arrow A in FIG. 2.

A C ring fastening device according to an embodiment of the present invention will be discussed hereinafter with reference to FIGS. 1 to 5. The C ring fastening device has a device body 2 and a magazine 4 attached to the body 2 for loading a C ring assembly (discussed hereinafter). Jaws 6 for deforming C rings (discussed hereinafter) are pivotally attached to the body 2. A main pneumatic cylinder 8 for moving the jaws 6 toward or away from each other is located on the body 2. When the main pneumatic cylinder 8 is extended, a jaw driving mechanism (not shown) causes the jaws 6 to be moved away from each other. When the main pneumatic cylinder 8 is contracted, the jaw driving mechanism causes the jaws 6 to be moved toward each other. A push button type directional control valve 10 is provided at the body 2. A push button 12 of the directional control valve 10 is protruded from the body 2. The C ring fastening device is provided with a trigger 14 for depressing the push button 12. An air flowing passage 16 is provided in the body 2. The air flowing passage 16 communicates with an air pressure supply port of the directional control valve 10. An air hose 18 is connected at one end thereof to the air flowing passage 16 and can be connected at the other end thereof to a compressed air supply device (not shown). Air flowing passages 20, 22 are provided in the body 2 and communicate with discharge ports of the directional control valve 10.

Moreover, a holding plate 24 is fixed to the body 2. A feed pneumatic cylinder 26 is fixed to the holding plate 24. That is, the feed pneumatic cylinder 26 is fixed to the body 2. A port 8*a* (discussed hereinafter) of the main pneumatic cylinder 8 and the feed pneumatic cylinder 26 are connected by an air hose 28. As will be discussed hereinafter, the feed pneumatic cylinder 26 is configured to be contracted (discussed hereinafter) when the jaws 6 are moved away from each other. A moving plate 32 is attached to a piston rod 30 of the feed pneumatic cylinder 26. A push spring 34 is provided between the holding plate 24 and the moving plate 32. That is, the push spring 34 serves to push the moving plate 32 in a feed direction with respect to a body of the feed pneumatic cylinder 26. Two feed member supporting portions 36 are located on the moving plate 32. Support shafts 38 are attached to the feed member supporting portions 36 Center lines of the support shafts 38 are perpendicular to a feeder blade of the jaw driving mechanism. Feed members 40*a*, 40*b* are rotatably attached to the support shafts 38. That is, the feed members 40*a*, 40*b* are rotatably supported to the feed member supporting portions 36. In this way, the two feed members 40*a*, 40*b* are located on the moving plate 32. The feed members 40*a*, 40*b* are formed with a plurality of grooves 42. Longitudinal directions of the grooves 42 are parallel to the center lines of the support shafts 38. The shapes of the grooves 42 allow side portions of the C rings to be engaged in the grooves 42. The surfaces provided with the grooves 42 of the feed members 40*a*, 40*b* are located the feed members 40*b*, 40*a* side rather than the center lines of the support shafts 38, namely, on the inner sides (the surface provided with the grooves 42 of the feed member 40*a* is located in a downward direction of the sheet surface of FIG. 2 with respect to the center line of a corresponding support shaft 38, and the surface provided with the grooves 42 of the feed member 40*b* is located in an upward direction of the sheet surface of FIG. 2 with respect to the center line of a corresponding support shaft 38), and on the feed direction side (right direction of the sheet surface of FIG. 2). Spiral springs 44*a*, 44*b* are provided around the support shafts 38. Ends of the spiral springs 44*a*, 44*b* are attached to the feed member supporting portions 36. The other ends of the spiral springs 44*a*, 44*b* are attached to the feed members 40*a*, 40*b*. The spiral spring 44*a* urges the feed member 40*a* to cause the feed member 40*a* to be rotated in a clockwise direction on the sheet surface of FIG. 2. The spiral spring 44*b* urges the feed member 40*b* to cause the feed member 40*b* to be rotated in a counterclockwise direction on the sheet surface of FIG. 2. A feed mechanism 46 includes the moving plate 32 and the feed members 40*a*, 40*b*. A feed device includes the feed pneumatic cylinder 26 and the feed mechanism 46.

A stopper 50 which is made of a spring steel plate is attached to the holding plate 24 by a screw 48. That is, the stopper 50 is attached to the body 2. The stopper 50 includes first engaging portions 52, a second engaging portion 54, and a releasing portion 56. In the state shown in FIG. 4, the engaging portions 52, 54 are in contact with the magazine 4. However, when the C ring assembly is loaded on the magazine 4, the engaging portions 52, 54 are engaged with the C ring assembly loaded on the magazine 4. The engaging portion 54 is engaged, on the side opposite to the feed direction with respect to the engaging portions 52, with the C ring assembly loaded on the magazine 4. The stopper 50 prevents the C ring assembly loaded on the magazine 4 from moving in the direction opposite to the feed direction.

Figure 6:
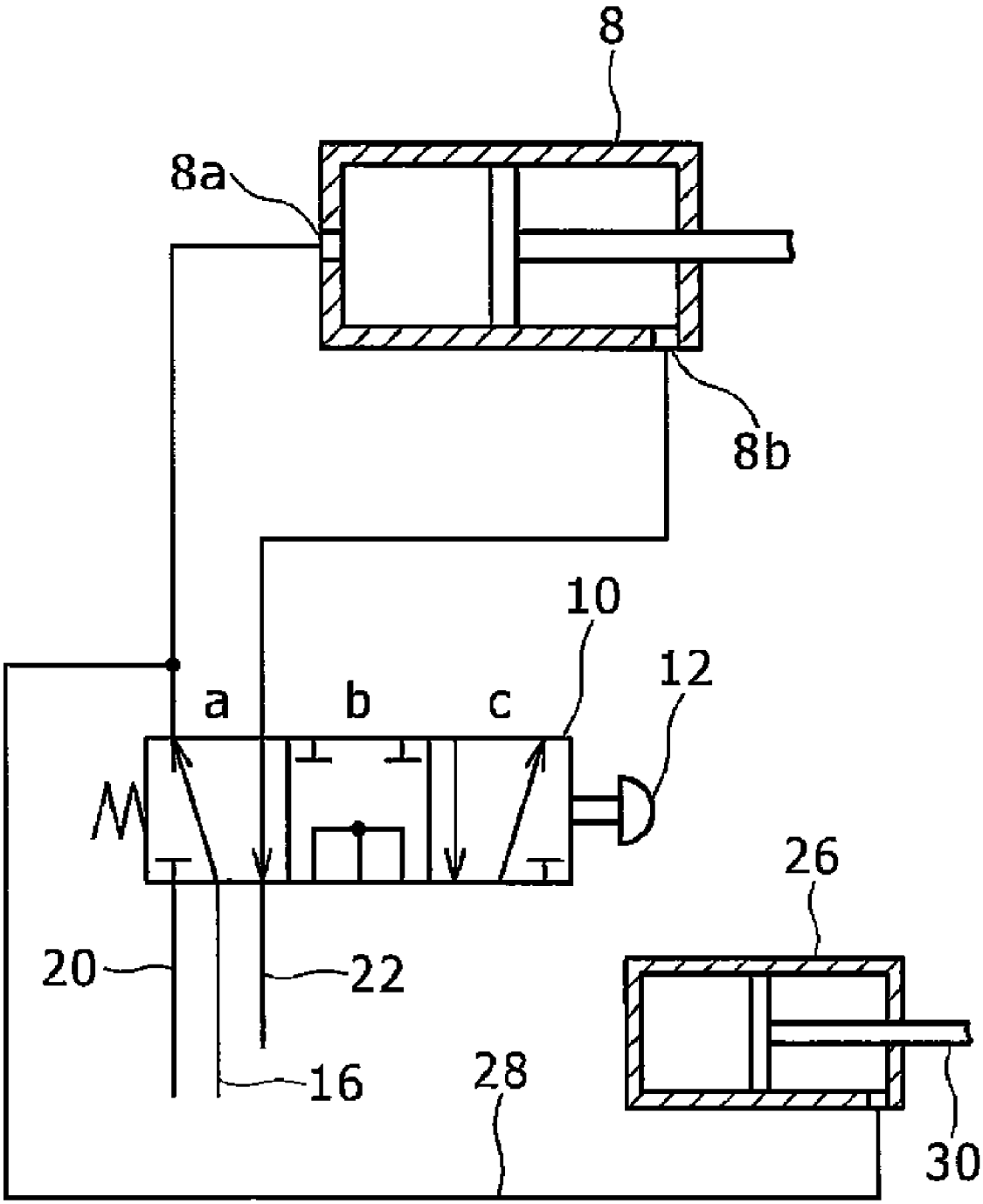
FIG. 6 is a circuit diagram of a pneumatic circuit for pneumatic cylinders of the C ring fastening device shown in FIGS. 1 to 5.

Referring to FIG. 6, a pneumatic circuit for the pneumatic cylinder of the C ring fastening device shown in FIGS. 1 to 5 will be discussed hereinafter. In a state where the directional control valve 10 is set in a position a, the air flowing passage 16 and the port 8*a* of the main pneumatic cylinder 8 are connected and a port 8*b* of the main pneumatic cylinder 8 and the air flowing passage 22 are connected. In a state where the directional control valve 10 is set in a position b, the air flowing passages 16, 20, 22 are communicated. In a state where the directional control valve 10 is set in a position c, the air flowing passage 16 and the port 8*b* of the main pneumatic cylinder 8 are connected and the port 8*a* of the main pneumatic cylinder 8 and the air flowing passage 20 are connected.

Figure 7:
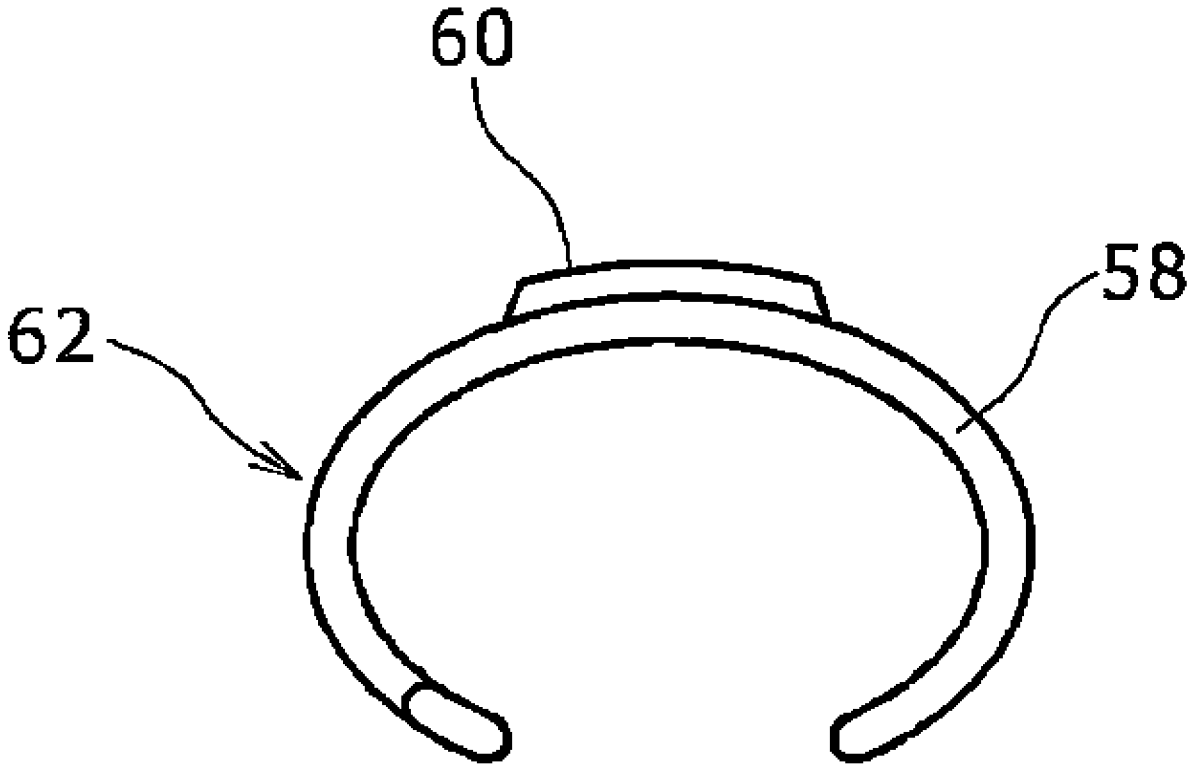
FIG. 7 is a front view illustrating a C ring assembly.
Figure 8:
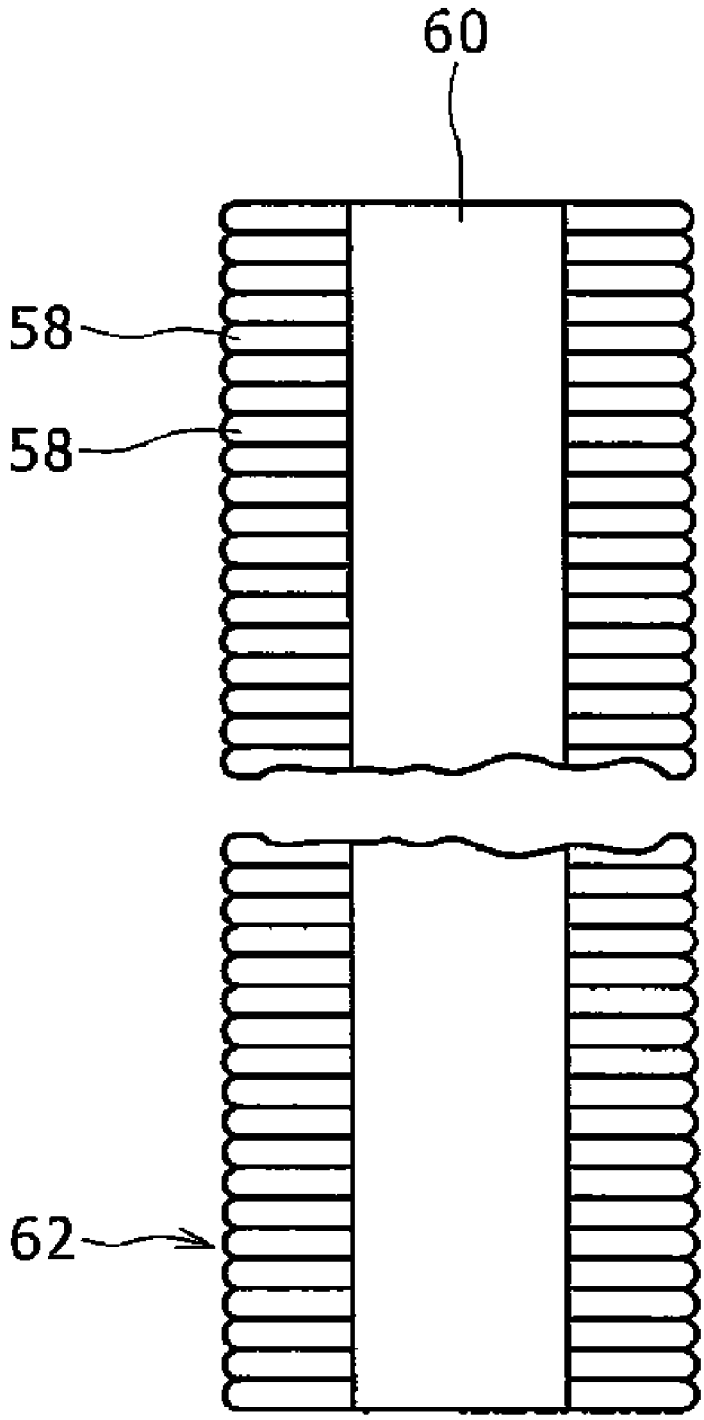
FIG. 8 is a plane view illustrating the C ring assembly shown in FIG. 7.

Referring to FIGS. 7 and 8, the C ring assembly will be discussed hereinafter. A plurality of C rings 58 are arranged in a row. An adhesive tape 60 is attached to the backs of the C rings 58 to form the C ring assembly 62 in which the plurality of C rings 58 are integrated.

In the C ring fastening device constructed as discussed above, when an operator pulls the trigger 14 in a state where the C ring assembly 62 is loaded on the magazine 4, the jaws 6 deform the C ring 58, thus performing a fastening operation. That is, in a state where the compressed air supply device is connected to the other end of the air hose 18 and the trigger 14 is not pulled, the directional control valve 10 is set in the position a to supply compressed air from the compressed air supply device into the port 8*a* of the main pneumatic cylinder 8. Consequently, the main pneumatic cylinder 8 is extended to move the jaws 6 away from each other and a C ring 58 is fed to tip end portions of the jaws 6, namely fastening portions. When the operator pulls the trigger 14 in this state, the position of the directional control valve 10 is changed from the position a via the position b to the position c to feed the compressed air to be fed into the port 8*b* of the main pneumatic cylinder 8 from the compressed air supply device. Consequently, the main pneumatic cylinder 8 is contracted and the jaws 6 are moved toward each other to deform the C ring 58 at the fastening portions. The deformed C ring 58 fastens members to be fastened together. When the operator releases his/her finger from the trigger 14 in this state, the position of the directional control valve 10 is changed from the position c via the position b to the position a. Consequently, the compressed air is fed into the port 8*a* of the main pneumatic cylinder 8 from the compressed air supply device, whereby the main pneumatic cylinder 8 is extended, the jaws 6 are moved away from each other, and the C ring 58 is fed to the fastening portions. Thus, the fastening operation is performed.

Moreover, in a state where the magazine 4 is loaded with the C ring assembly 62, the feed members 40*a*, 40*b* are urged by the spiral springs 44*a*, 44*b*, so that opposite side portions of the C rings 58 are brought into a condition of engaging in the grooves 42 of the feed members 40*a*, 40*b*. When the trigger 14 is not pulled and the directional control valve 10 is set in the position a, the compressed air is supplied to the feed pneumatic cylinder 26 to move the piston rod 30 toward the inside of the body of the feed pneumatic cylinder 26 (i.e., move the piston rod 30 in the left direction of FIGS. 3 and 6). Consequently, the moving plate 32 is moved in the direction opposite to the feed direction, namely the left direction on the sheet surface of FIG. 3 and the push spring 34 is compressed. At this time, the engaging portions 52, 54 of the stopper 50 are fitted in recess portions formed between adjacent C rings 58 of the C ring assembly 62 and the C ring assembly 62 is therefore brought into a state of being prevented from moving in the direction opposite to the feed direction, by the stopper 50, namely, a stopped state. Therefore, the C ring assembly 62 does not move in the direction opposite to the feed direction. Moreover, since the surfaces provided with the grooves 42 of the feed members 40*a*, 40*b* lie on the inner side of the center lines of the support shafts 38 and on the feed direction side, the feed members 40*a*, 40*b* turn against the resilience of the spiral springs 44*a*, 44*b*. Therefore, the feed members 40*a*, 40*b* move in the direction opposite to the feed direction. When the operator pulls the trigger 14 in this state, the position of the directional control valve 10 is changed from the position a via the position b to the position c and the feed pneumatic cylinder 26 is communicated with the air flowing passage 20. Consequently, the push spring 34 pushes the moving plate 32 and the feed members 40*a*, 40*b* in the feed direction, namely, in the right direction on the sheet surface of FIG. 3. Since the side portions of the C rings 58 engage in the grooves 42 of the feed members 40*a*, 40*b* at this time and the surfaces provided with the grooves 42 of the feed members 40*a*, 40*b* lie on the inner side of the center lines of the support shafts 38 and on the feed direction side, the feed members 40*a*, 40*b* do not turn. Consequently, the feed members 40*a*, 40*b* do not move relative to the C ring assembly 62. Therefore, the C ring assembly 62 is brought into a state of being pushed in the feed direction by the feed members 40*a*, 40*b* and, when the contraction of the main pneumatic cylinder 8 is completed, the C ring assembly 62 is fed in the feed direction by a distance corresponding to one C ring 58. At this time, the engaging portions 52, 54 are moved in the upper/lower direction on the sheet surface of FIG. 4 in contact with the C ring assembly 62, so that the movement of the C ring assembly 62 in the feed direction is not prevented by the stopper 50. When the operator releases his/her finger from the trigger 14 in this state, the position of the directional control valve 10 is changed from the position c via the position b to the position a and the piston rod 30 is moved toward the inside of the body of the feed pneumatic cylinder 26 (i.e., move the piston rod 30 in the left direction of FIGS. 3 and 6), so that the moving plate 32 and the feed members 40*a*, 40*b* are moved in the direction opposite to the feed direction and the push spring 34 is compressed. and the push spring 34 is compressed.

In this way, in the state where the trigger 14 is not pulled, the jaws 6 are moved away from each other, the feed members 40*a*, 40*b* are moved in the direction opposite to the feed direction, and the push spring 34 is compressed. When the operator pulls the trigger 14 in this state, the jaws 6 are moved toward each other, whereby the members to be fastened are fastened by the C ring 58, the feed members 40*a*, 40*b* are pushed in the feed direction by the push spring 34, the C ring assembly 62 is pushed in the feed direction by the feed members 40*a*, 40*b*, and the C ring assembly 62 is fed in the feed direction by the distance corresponding to the one C ring 58. When the operator releases his/her finger from the trigger 14 in this state, the jaws 6 are moved away from each other, the feed members 40*a*, 40*b* are moved in the direction opposite to the feed direction, and the push spring 34 is compressed.

Figure 4:
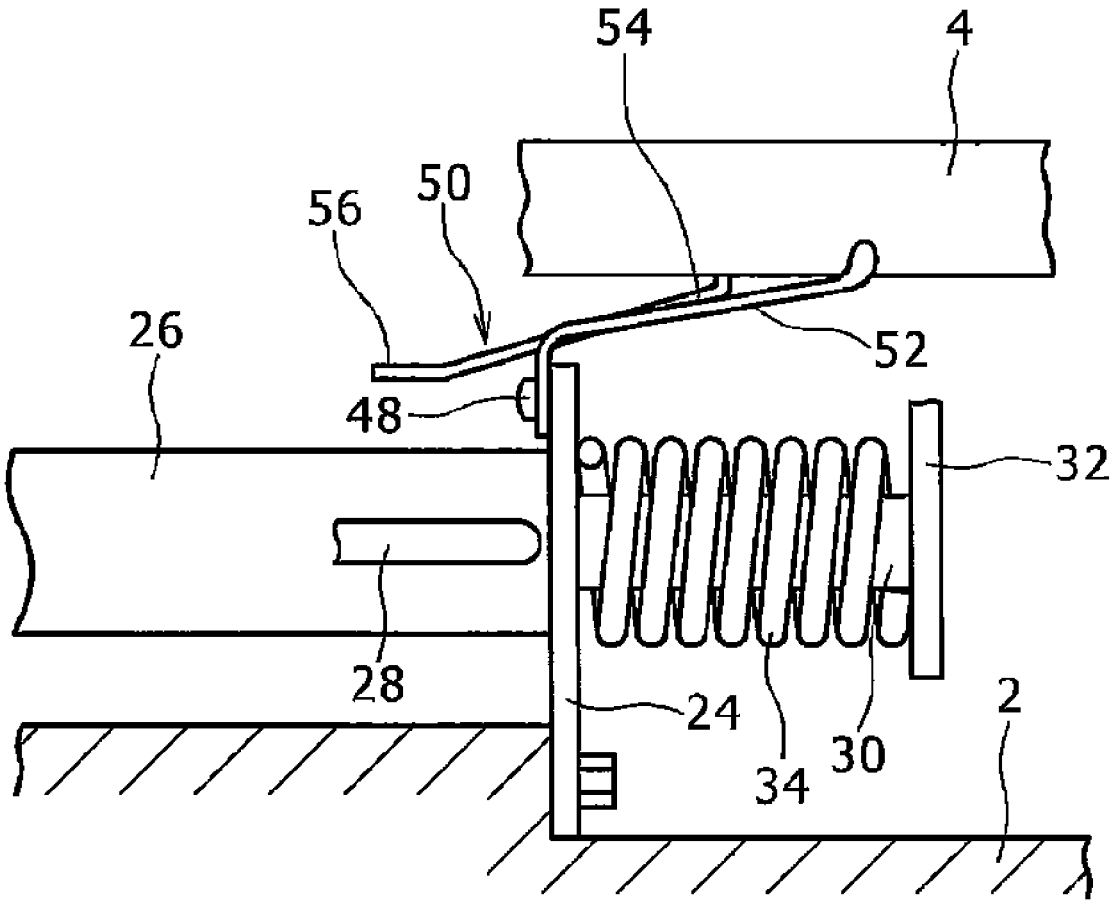
FIG. 4 is a partially abbreviated view of the C ring fastening device, as viewed from the arrow A in FIG. 2.
Figure 5:
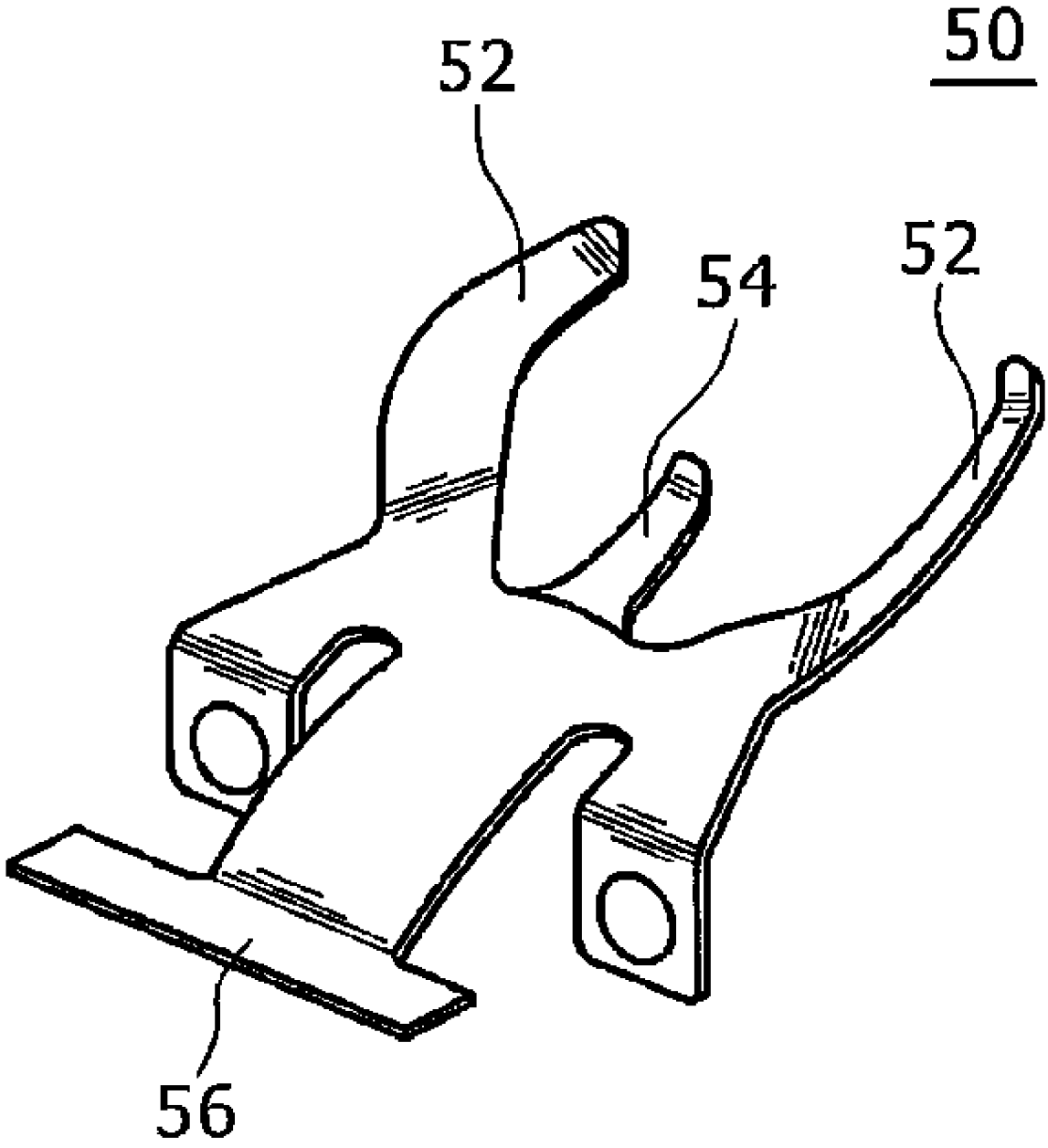
FIG. 5 is a perspective view illustrating a stopper that is used in the C ring fastening device shown in FIGS. 1 to 4.

Moreover, when the operator pushes up the releasing portion 56 with his/her finger in the upper direction of the sheet surface of FIG. 4, the engaging portions 52, 54 are moved in the lower direction of the sheet surface of FIG. 4, and the engaging portions 52, 54 are disengaged from the recess portions formed between the adjacent C rings 58 of the C ring assembly 62, and the C ring assembly 62 is released from the stopped state by the stopper 50. Consequently, the C ring assembly 62 can be moved in the direction opposite to the feed direction. Moreover, in a state where a rear end portion of the C ring assembly 62 is not engaged with the engaging portion 54, when another C ring assembly 62 is loaded on the magazine 4, the forefront portion of the above-mentioned another C ring assembly 62 is engaged with the engaging portion 54.

In the C ring fastening device constructed as discussed above, the provision of the feed mechanism 46 is sufficient and any pusher mechanism is not required, so that the structure of the C ring fastening device is simple and the production cost of the C ring fastening device is low. Moreover, the C ring assembly 62 is pushed by the force of the push spring 34, so that regardless of the pressure of air supplied to the feed pneumatic cylinder 26, the C ring assembly 62 can be pushed by a constant force. Moreover, the two feed members 40*a*, 40*b* are provided and the C ring assembly 62 can be interposedly held by the two feed members 40*a*, 40*b*, so that the C ring assembly 62 can be securely pushed in the feed direction. In addition, since the feed members 40*a*, 40*b* which are rotatably supported to the feed member supporting portion 36 and formed with the plurality of grooves 42 are employed and the side portions of the C rings 58 are engaged in the grooves 42, the C ring assembly 62 can be pushed in the feed direction with certain. Moreover, in the state where the rear end portion of the C ring assembly 62 is not engaged with the engaging portion 54, when the above-mentioned another C ring assembly 62 is loaded on the magazine 4, the forefront portion of the above-mentioned another C ring assembly 62 is engaged with the engaging portion 54, whereby the loading operation of the above-mentioned another C ring assembly 62 can be easily performed. Moreover, since the stopper 50 is provided with the releasing portion 56, the stopped state of the C ring assembly by the stopper 50 can be easily released.

Figure 9:
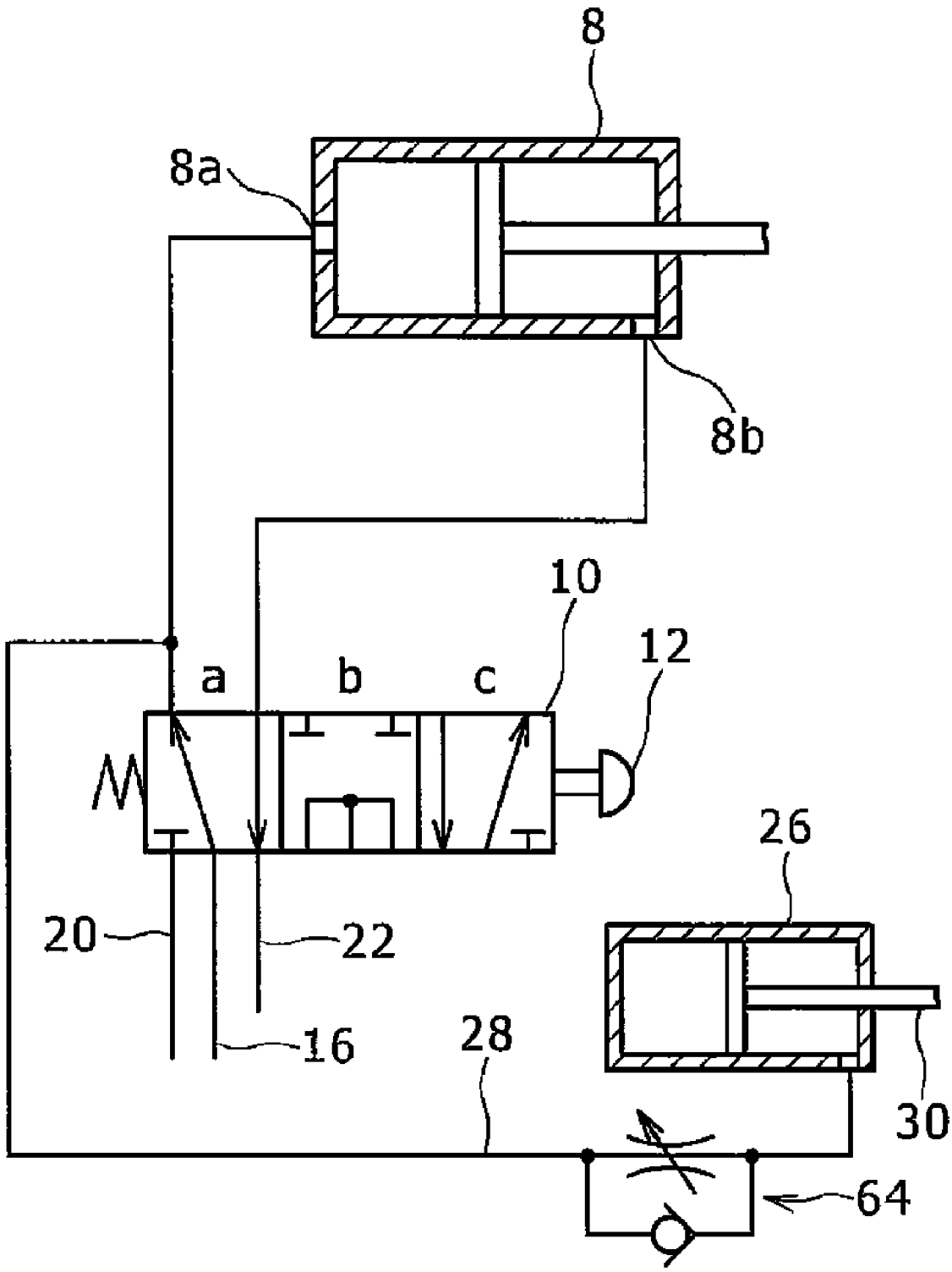
FIG. 9 is a circuit diagram of a pneumatic circuit for pneumatic cylinders of a C ring fastening device according to another embodiment of the present invention.

Incidentally, while the C ring fastening device has been discussed above with reference to the embodiment of the present invention, the present invention may be applied to a hog ring fastening device other than the C ring fastening device. Moreover, while the push spring 34 is provided between the holding plate 24 and the moving plate 32, any suitable push spring for pushing the feed plate in the feed direction relative to the body of the feed pneumatic cylinder may be provided between the body of the feed pneumatic cylinder and its piston. Moreover, by supplying air to the feed pneumatic cylinder 26 after a predetermined time has lapsed from the time the operator releases his/her finger from the trigger 14, or by providing speed controller 64 at the air hose 28 as shown in FIG. 9, when the operation speed of the feed pneumatic cylinder 26 is delayed, the C ring 58 is fed to the jaws 6 during the push spring 34 pushes the C ring assembly 62, whereby the C ring assembly can he fed with higher certainty.

It will be recognized by those skilled in the art that changes or modifications may be made to the above-described embodiments without departing from the broad inventive concepts of the present invention. It should therefore be understood that this invention is not limited to the particular embodiments described herein, but is intended to include all changes and modifications that are within the scope and spirit of the invention as set forth in the claims.

What is claimed is:

1. A hog ring fastening device comprising:

a body;

a magazine attached to the body;

jaws pivotally supported on the body;

a main pneumatic cylinder for moving the jaws toward or away from each other;

a feed pneumatic cylinder fixed to the body, wherein the feed pneumatic cylinder includes a main body and a piston rod, and the piston rod is adapted to be moved toward an inside of the main body when the jaws are moved away from each other;

a moving plate attached to the piston rod of the feed pneumatic cylinder;

a push spring around the piston rod for pushing the moving plate in a feed direction with respect to the main body of the feed pneumatic cylinder;

a feed member located on the moving plate; and a stopper attached to the body of the hog ring fastening device for preventing a hog ring assembly loaded on the magazine from moving in a direction opposite to the feed direction.

2. The hog ring fastening device according to claim 1, wherein the feed member includes two feed members.

3. The hog ring fastening device according to claim 1, wherein a feed member supporting portion is located on the moving plate, the feed member is rotatably supported to the feed member supporting portion.

4. The hog ring fastening device according to claim 3, wherein a support shaft is attached to the feed member supporting portion, the feed member being rotatably attached to the support shaft.

5. The hog ring fastening device according to claim 4, wherein a spiral spring is provided around the support shaft, the spiral spring is attached at one end thereof to the feed member supporting portion and attached at the other end thereof to the feed member.

6. The hog ring fastening device according to claim 5, the feed member is formed with a plurality of grooves.

7. The hog ring fastening device according to claim 1, wherein a holding plate is fixed to the body of the hog ring fastening device, the feed pneumatic cylinder is fixed to the holding plate, and the push spring is provided between the holding plate and the moving plate.

8. The hog ring fastening device according to claim 1, wherein the stopper includes first engaging portions and a second engaging portion adapted to be engaged, on a side opposite to the feed direction with respect to the first engaging portions, with the hog ring assembly loaded on the magazine.

9. The hog ring fastening device according to claim 8, wherein the stopper further includes a releasing portion.

* * * * *